US010631695B2

(12) United States Patent
Buss et al.

(10) Patent No.: US 10,631,695 B2
(45) Date of Patent: Apr. 28, 2020

(54) VACUUM SQUEEGEE ACCESSORY

(71) Applicant: SHOP VAC CORPORATION, Williamsport, PA (US)

(72) Inventors: Randy L. Buss, Muncy, PA (US); Melvin E. Wolfe, Jr., Johnson City, NY (US)

(73) Assignee: SHOP VAC CORPORATION, Williamsport, PA (US)

( * ) Notice: Subject to any disclaimer, the term of this patent is extended or adjusted under 35 U.S.C. 154(b) by 252 days.

(21) Appl. No.: 15/723,864

(22) Filed: Oct. 3, 2017

(65) Prior Publication Data

US 2018/0110385 A1 Apr. 26, 2018

Related U.S. Application Data

(60) Provisional application No. 62/412,658, filed on Oct. 25, 2016.

(51) Int. Cl.

| | |
|---|---|
| ***A47L 9/06*** | (2006.01) |
| ***A47L 11/40*** | (2006.01) |
| ***A47L 7/00*** | (2006.01) |

(52) U.S. Cl.

CPC ..... *A47L 9/0673* (2013.01); *A47L 7/0009* (2013.01); *A47L 11/4044* (2013.01)

(58) Field of Classification Search

CPC ..... A47L 11/4044; A47L 13/11; A47L 13/12; A47L 7/0009; A47L 9/02; A47L 9/0673

USPC ..... 15/244.1, 245, 401

See application file for complete search history.

(56) References Cited

U.S. PATENT DOCUMENTS

| | | | | |
|---|---|---|---|---|
| 2,677,144 | A | 5/1954 | Parry | |
| 2,822,061 | A * | 2/1958 | Pettit | A47L 7/0009 15/321 |
| 2,893,046 | A | 7/1959 | Thompson | |
| 3,107,387 | A | 10/1963 | Katt | |
| 3,110,052 | A | 11/1963 | Whitman | |
| 3,118,165 | A | 1/1964 | Meyerhoefer | |

(Continued)

FOREIGN PATENT DOCUMENTS

| | | |
|---|---|---|
| DE | 102006033514 B3 | 12/2007 |
| WO | WO-2015/121718 A1 | 8/2015 |

OTHER PUBLICATIONS

International Search Report and Written Opinion, corresponding International Application No. PCT/US2017/054908, dated Jan. 8, 2018.

*Primary Examiner* — Joseph J Hail
*Assistant Examiner* — Arman Milanian
(74) *Attorney, Agent, or Firm* — Marshall, Gerstein & Borun LLP

(57) ABSTRACT

A squeegee accessory for a wet/dry vacuum may include a housing and a squeegee assembly removably attached to a front end of the housing. The housing may include a front end including a fluid inlet, a back end including a fluid outlet, and a fluid flow path connecting the inlet and the outlet. The squeegee assembly may include a bracket, a squeegee removably disposed between first and second plates of the bracket, and an insert removably disposed between first and second blades of the squeegee. The insert may have an elongated body and a rib disposed on the elongated body, the rib touching the inner surface of the squeegee to define a barrier of an airflow path formed between the insert and the squeegee.

27 Claims, 11 Drawing Sheets

(56) References Cited

U.S. PATENT DOCUMENTS 3,210,792 A * 10/1965 Sassano, Sr. ..... A47L 11/30 15/401
3,571,841 A * 3/1971 Crouser ..... A47L 9/02 15/401
4,475,265 A 10/1984 Berfield
4,557,013 A 12/1985 Belmont
4,809,386 A 3/1989 Re
5,184,372 A * 2/1993 Mache ..... A47L 7/0009 15/245
5,280,666 A 1/1994 Wood et al.
5,377,382 A * 1/1995 Bores ..... A47L 11/4044 15/245
5,419,007 A 5/1995 Hult et al.
5,666,685 A 9/1997 von Grolman et al.
5,911,260 A * 6/1999 Suzuki ..... A47L 11/4044 15/320
5,933,911 A * 8/1999 Windmeisser ..... A47L 11/302 15/320
6,279,198 B1 8/2001 Martin et al.
6,647,585 B1 * 11/2003 Robinson ..... A47L 9/02 15/322
7,254,867 B2 8/2007 Legatt et al.
7,661,175 B2 2/2010 Hollis
7,694,382 B2 * 4/2010 Williams ..... A47L 11/30 15/321
7,832,049 B2 11/2010 Hollis
7,870,639 B2 1/2011 Thomas
8,302,254 B2 * 11/2012 Schuetz ..... A47L 11/4044 15/401
2005/0166359 A1 * 8/2005 Wertz ..... A47L 5/36 15/327.5
2009/0070955 A1 3/2009 Hollis
2009/0300868 A1 * 12/2009 Oberhaensli ..... A47L 11/30 15/245

* cited by examiner

VACUUM SQUEEGEE ACCESSORY

FIELD OF DISCLOSURE

The present disclosure generally relates to a cleaning accessory for a wet/dry vacuum cleaner and, in particular, a squeegee accessory for a wet/dry vacuum.

BACKGROUND OF THE DISCLOSURE

An electric vacuum cleaner generally includes a suction generating apparatus, such as a suction fan, which communicates with an intake orifice of an accessory attached to the vacuum hose. At the intake orifice, the force of suction is greatest, but the intake orifice may be shaped to achieve different suction airflow characteristics. For example, to increase suction force at the intake orifice, the accessory typically may have a reduced width across at least one dimension of the orifice, which correlates to an increase in the speed of air flow through the orifice. Wet/dry vacuum cleaners may suction dry particulate materials, wet or damp materials, and even liquids. Dry particulate materials are lighter in weight and can be suctioned using a smaller suction force. Wet materials and liquids require a relatively greater suction force to be suctioned.

Squeegee cleaning accessories generally include a wide rubber blade to clean smooth surfaces by squeegeeing liquid. When attached to a wet/dry vacuum, the blade of the squeegee accessory funnels wet/dry particulate toward the intake orifice, which is securely connected to a hose or wand. Conventional designs for squeegee accessories often concentrate the force of suction at or near the center of the squeegee blade, which may lead to removal of only the wet/dry particulate that is located near the intake orifice. Additionally, a squeegee accessory with a single squeegee blade may only funnel we or dry particulate material toward the intake orifice when used in a single direction.

SUMMARY

It is believed that a squeegee accessory according to aspects of the present disclosure more effectively harnesses the suction force of a wet/dry vacuum cleaner to clean a wide target surface area that extends beyond the intake orifice of the accessory. In this way, the squeegee accessory of the present disclosure may save energy and/or reduce cleaning time. In some configurations, the squeegee accessory may redirect air flow so that a wet/dry vacuum can maximize the debris gathered by the squeegee blades of the accessory. In some configurations, the squeegee accessory may be easily attached to a vacuum hose, easily disassembled to replace individual parts, and/or may be combined with an additional cleaning accessory.

In accordance with a first exemplary aspect, a squeegee accessory for a wet/dry vacuum may include a housing having a front end including a fluid inlet, a back end including a fluid outlet, and a fluid flow path connecting the inlet and the outlet. A squeegee assembly may be removably attached to the housing and disposed within the fluid flow path. The squeegee assembly may include a bracket including a first plate, a second plate, and an end wall connecting the first and second plates, where the end wall may include an aperture to permit fluid flow between the inlet and the outlet. The squeegee assembly may further include a squeegee removably disposed between the first and second plates of the bracket. The squeegee may include a first blade, a second blade, and an elbow connecting the first and second blades, where the elbow is located adjacent to the end wall and includes an aperture to permit fluid flow between the inlet and the outlet. Further, an insert may be removably disposed between the first and second blades of the squeegee. The insert may have an elongated body and a rib disposed on the elongated body. The rib may touch the inner surface of the squeegee so that the rib and the inner surface of the squeegee define a barrier of an airflow path formed between the insert and the squeegee. The front end of the housing may include a receiving cavity that receives the squeegee assembly.

In accordance with a second exemplary aspect, an attachment for a vacuum may include a squeegee assembly having a squeegee with a first blade, a second blade, and an elbow connecting the first and second blades, where the elbow includes an aperture. An insert may be disposed between the first blade and the second blade of the squeegee. The insert may have an elongated body that defines a plurality of air flow paths between the insert and the squeegee. Further, the attachment may include a housing with a front end and a back end fluidly connected by a fluid flow path. The squeegee assembly may be removably attached to the housing at the front end.

In accordance with a third exemplary aspect, an attachment for use with a vacuum cleaner may include a housing having a front end including an inlet, a back end including an outlet, and a fluid flow path connecting the inlet and the outlet. A tube may define the outlet, may be disposed at the back end of the housing, and may be configured to attach to a hose of a vacuum. A squeegee assembly may be disposed within an opening of the housing at the front end and also disposed within the fluid flow path. The squeegee assembly may include a bracket having a first plate, a second plate, and an end wall connecting the first plate and second plate. The bracket may include a substantially U-shaped cross-section extending a length of the front end of the housing, and the end wall may include an aperture. A squeegee may be disposed between the first plate and the second plate of the bracket, and may include a first blade and a second blade. An insert may be disposed between the first blade and the second blade of the squeegee. The insert may have an elongated body having a parallel front edge and back edge, and the front edge may be inclined and the back edge may be positioned adjacent to the elbow of the squeegee. A rib may be perpendicularly situated relative to the front edge and back edge and disposed on the inclined edge. The at least one rib may sealingly engage an inner surface of the squeegee. Further, a clamping assembly having a biasing plate disposed within the inlet of the housing and a spring-biased knob may be configured to lock the squeegee assembly to the housing and unlock the squeegee assembly from the housing.

In further accordance with any one or more of the foregoing aspects, the attachment and/or accessory may include any one or more of the following forms.

In some forms, the squeegee may include a substantially U-shaped cross-section defined by the elbow, the first blade, and the second blade, where the substantially U-shaped cross-section extends between a first end and a second end.

In some forms, the elongated body of the insert may include a first capped end and a second capped end. The first capped end may sealingly engage with the first end of the squeegee, and/or the second capped end may sealingly engage with the second end of the squeegee.

In some forms, the elongated body of the insert may include a plurality of ribs engaged with an inner surface of the first blade of the squeegee. The plurality of ribs may define air flow paths between the insert and the first squeegee blade.

In some forms, the elongated body of the insert may include another plurality of ribs engaged with an inner surface of the second blade of the squeegee. The plurality of ribs may define a plurality of air flow paths within the fluid flow path of the housing.

In some forms, an inclined ridge may be disposed on the inner surface of the squeegee. The inclined ridge may be configured to keep the first blade and the second blade of the squeegee spaced apart to allow fluid to flow into the inlet of the housing.

In some forms, the elongated body of the insert may include a front edge and a back edge. The back edge may be disposed adjacent to the elbow of the squeegee.

In some forms, a length of the bracket may be approximately equal to a length of the elongated body of the insert and a length of the squeegee.

In some forms, a receiving clip may be disposed on an exterior surface of the housing and configured to receive a removable post for a cleaning attachment.

In some forms, a clamping assembly configured to lock and/or unlock the squeegee assembly from the housing may be provided. The clamping assembly may include a biasing plate disposed within the inlet of the housing and a spring-biased knob. The clamping assembly may be configured to lock the squeegee assembly to the housing by biasing the biasing plate against the bracket of the squeegee.

In some forms, an elevated knob may be disposed on the elongated body of the insert and in contact with the squeegee. The elevated knob may define a barrier for at least one of the plurality of airflow paths defined between the elongated body and the squeegee.

In some forms, the squeegee may include an elbow connecting the first and second blades. The elbow may have an aperture and may be integrally formed with the first blade and the second blade.

In some forms, the squeegee may have a length defined between a first end and a second end. The length of the squeegee may be approximately equal to a length of the elongated body of the insert.

In some forms, the housing may include a receiving cavity formed in the front end and sized to receive the squeegee assembly. The housing may include a top cover and a bottom cover secured to the top cover. The top cover and the bottom cover may form the receiving cavity.

BRIEF DESCRIPTION OF THE DRAWINGS

The features of this invention which are believed to be novel are set forth with particularity in the appended claims. The invention may be best understood by reference to the following description taken in conjunction with the accompanying drawings, in which like reference numerals identify like elements in the several Figures, in which:

DETAILED DESCRIPTION

Figure 1:
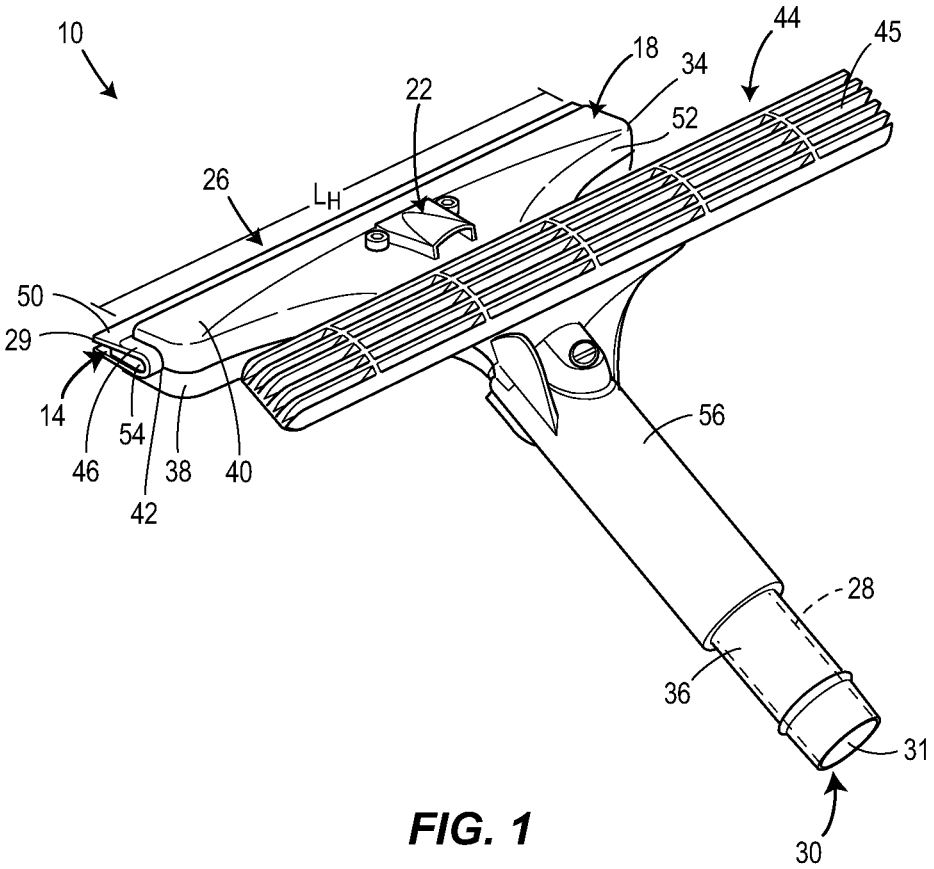
FIG. 1 is a perspective view of a first exemplary vacuum squeegee accessory and a cleaning post attachment in accordance with the principles of the present disclosure.
Figure 2:
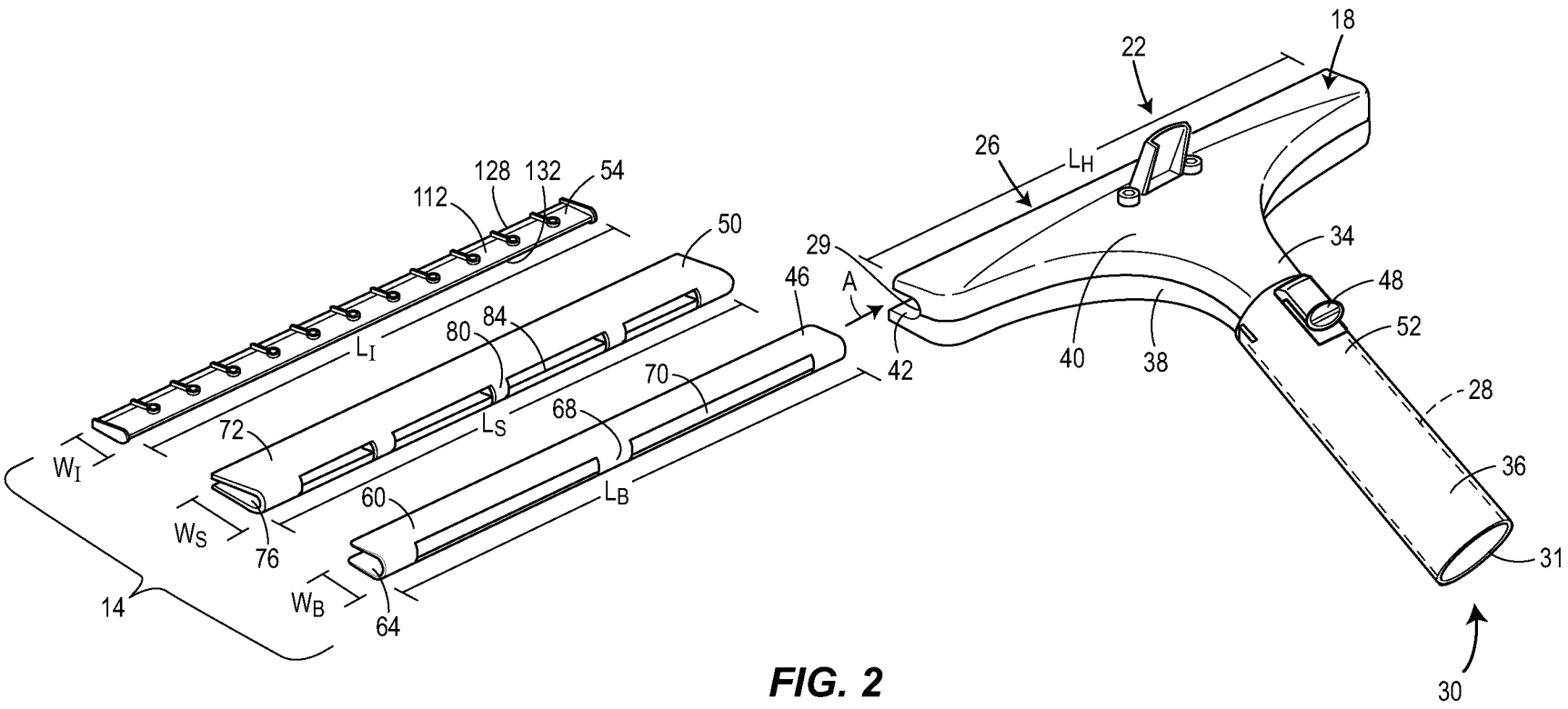
FIG. 2 is an exploded view of a squeegee assembly and housing of the vacuum squeegee accessory of FIG. 1.
Figure 7:
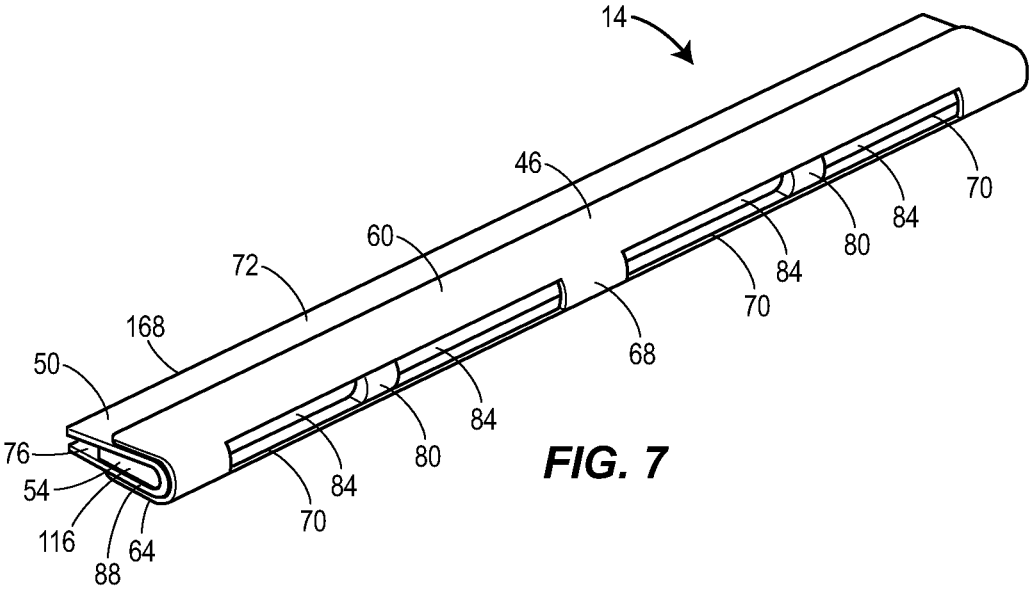
FIG. 7 is a perspective view of the squeegee assembly of FIG. 1 in an assembled condition.
Figure 7C:
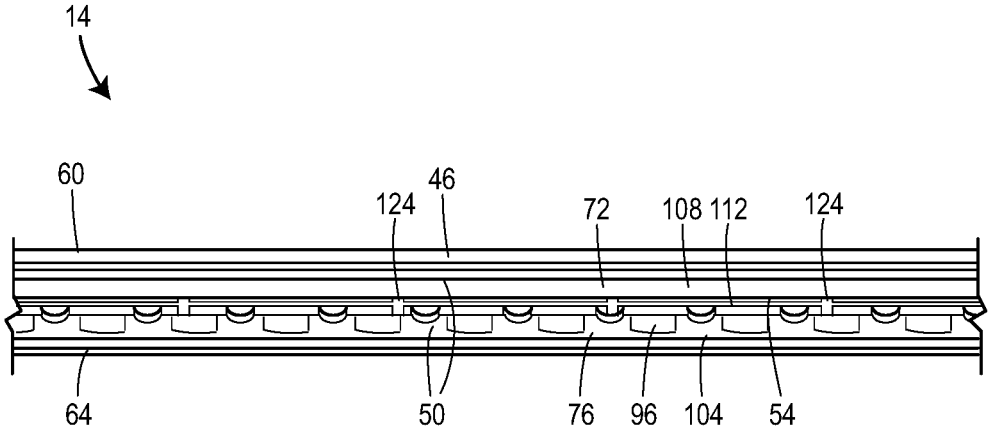
FIG. 7C is a partial front view of the squeegee assembly of FIG. 7.
Figure 8:
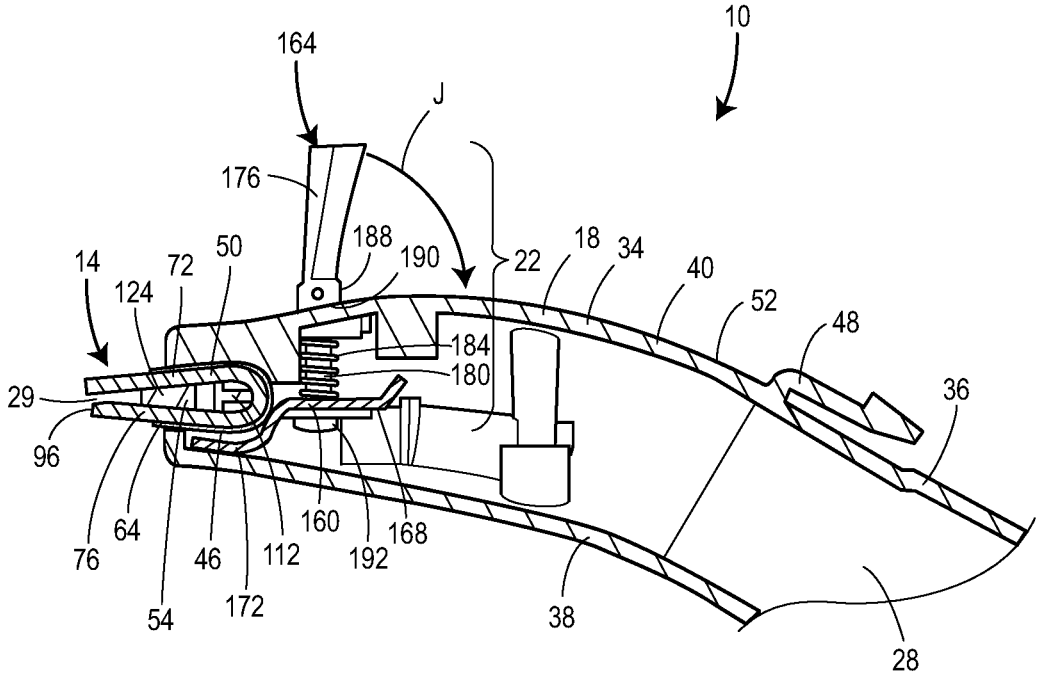
FIG. 8 is a cross-sectional view of the vacuum squeegee accessory of FIG. 1 in an unlocked position.
Figure 9:
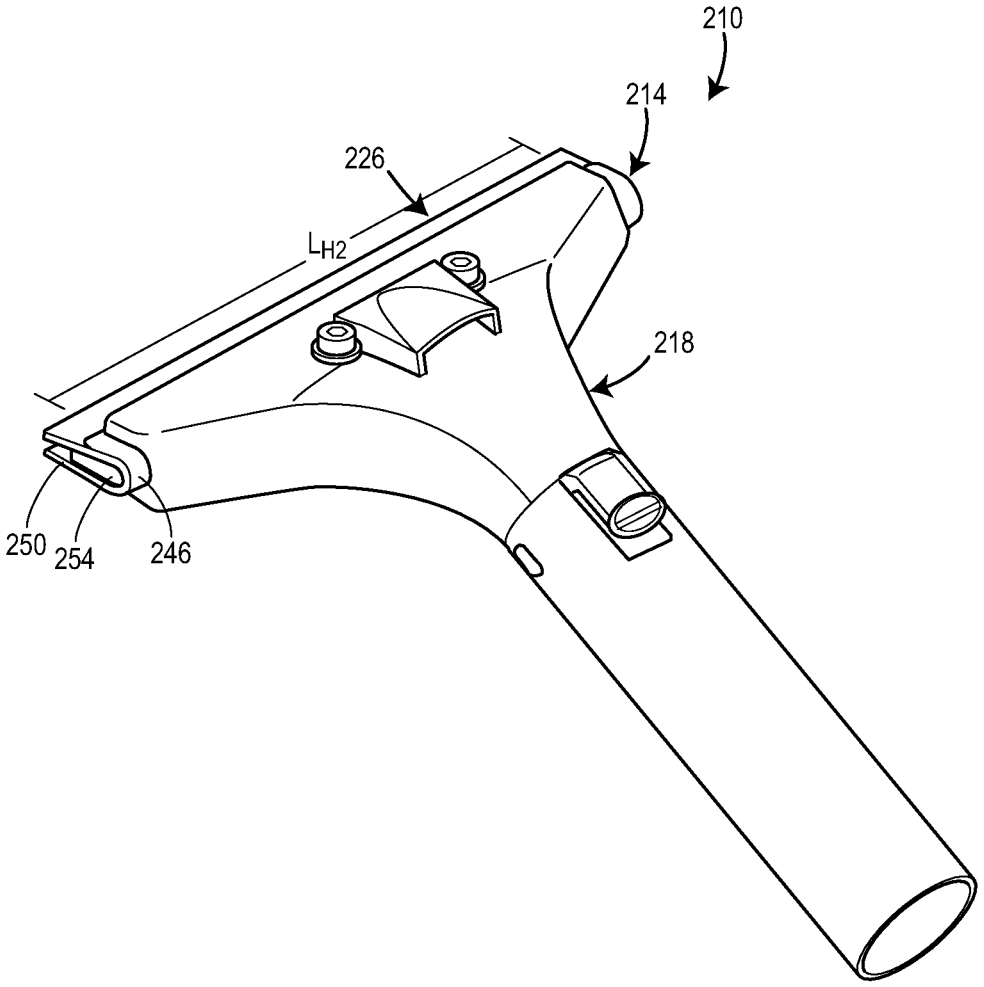
FIG. 9 is a second exemplary vacuum squeegee accessory in accordance with the principles of the present disclosure.

The vacuum squeegee accessory described and illustrated herein may attach to a hose of a wet/dry vacuum cleaner and may provide substantially uniform air suction across a squeegee assembly to remove both solids and liquids from a smooth surface. FIGS. 1-2 illustrate a first exemplary embodiment of a vacuum squeegee accessory 10, also referred herein as an attachment; FIGS. 3-7C illustrate a squeegee assembly 14 of the accessory 10 and views of each component of the squeegee assembly 14; FIG. 8 shows a clamping assembly 22 for locking and releasing the squeegee assembly 14 from a housing 18; and FIG. 9 is a second exemplary vacuum squeegee accessory.

Turning first to FIGS. 1-2, the vacuum squeegee accessory 10 for a wet/dry vacuum includes a squeegee assembly 14 removably attached to a housing 18 by a clamping assembly 22. The housing 18 includes a front end 26 defining a fluid inlet 29, a back end 30 defining a fluid outlet 31, and a fluid flow path 28 extending through the housing 18 and connecting the inlet 29 and the outlet 31. In this example, the housing 18 includes a top cover 34 and a bottom cover 38 secured to the top cover 34. At the front end 26 of the housing 18, the top cover 34 and the bottom cover 38 form a receiving cavity 42 sized to receive the squeegee assembly 14. In the illustrated example, the top cover 34 of the housing 18 includes two portions: a cylindrical tube 36 disposed at the back end 30 of the housing 18 and a top clam shell portion 40 that gradually curves outwardly into the wide front end 26 having a length $L_H$. However, in other examples the housing 18 may include more or fewer components arranged in the same or different manner. The bottom cover 38, in this example, attaches to the top clam shell portion 40 of the top cover 34. The tube 36 is configured to attach to a hose of a wet/dry vacuum. The housing 18 may be molded from a plastic, such as, for example, polypropylene. In another example, the top and bottom covers 34 and 38 of the housing 18 may be integrally formed housing cover. The squeegee accessory 10 may be used in dry conditions and may be used in wet conditions. As used herein, the term "fluid" includes all fluids and therefore "fluid flow" is not limited to liquid flow and includes, for example, air flow.

The squeegee accessory 10 of FIG. 1 includes an optional cleaning attachment 44. In this example, the cleaning attachment 44 includes a post 45 or a cleaning head, which may receive cleaning tool (e.g. a sponge, rag, or towel), and a tubular handle 56. The cleaning attachment 44 attaches to a receiving clip 48 (illustrated in FIG. 2) disposed on an exterior surface 52 of the housing 18 by sliding the tubular handle 56 over the tube 36. In FIG. 1, the cleaning attachment 44 is oriented such that the cleaning head 45 is positioned above the top cover 34 of the housing 18. However, the cleaning attachment 44 may be attached to the housing 18 at a variety of positions around the circumference of the tube 36. In one example, the attachment 44 is positioned 180 degrees from the orientation of FIG. 1 such that the cleaning head 45 is positioned below the bottom cover 38 of the housing 18. Use of the cleaning attachment 44 is optional, and it is therefore configured to easily attach or be detached from the squeegee accessory 10.

Figure 7A:
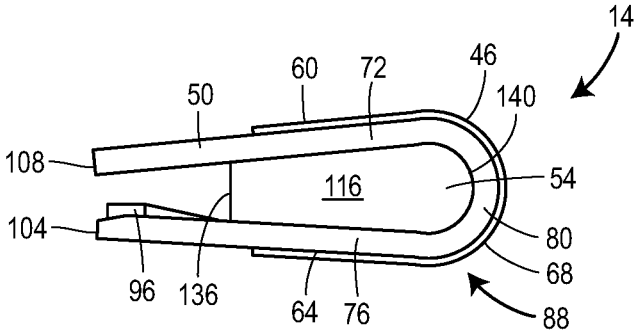
FIG. 7A is a side view of the squeegee assembly of FIG. 7.
Figure 7B:
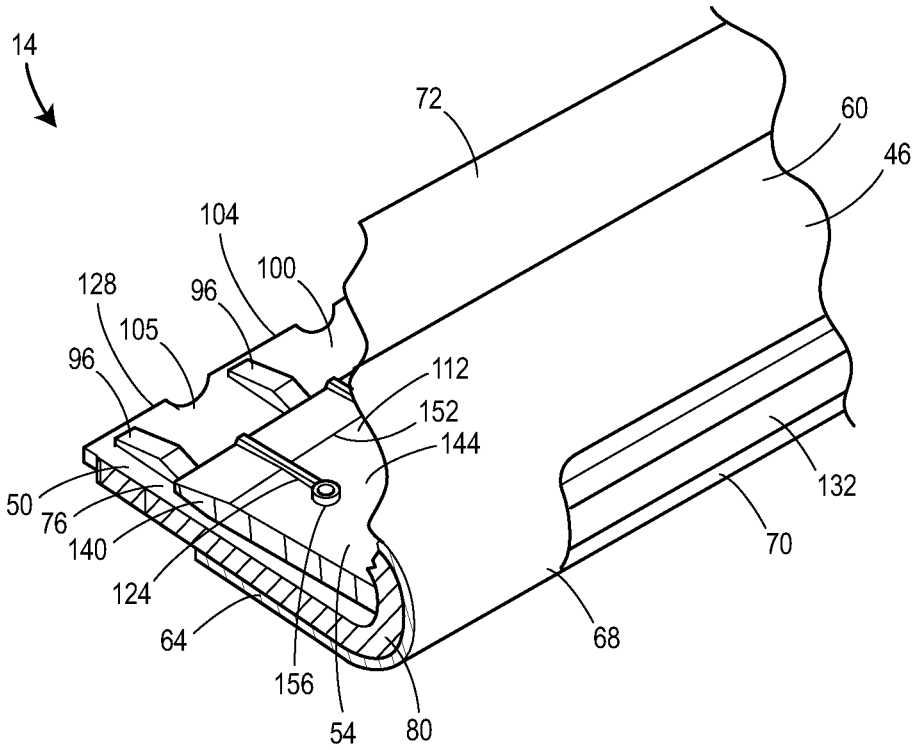
FIG. 7B is a perspective cut-away view of the squeegee assembly of FIG. 7.

In the exploded view of the squeegee accessory 10 of FIG. 2, the individual components of the squeegee assembly 14 are shown disassembled and removed from the receiving cavity 42 of the housing 18. The squeegee assembly 14 includes a bracket 46, a squeegee 50, and an insert 54. When assembled (as shown in FIGS. 7-7C), the bracket 46 holds the insert 54 and squeegee 50 together and, as a unit, is disposed within the receiving cavity 42 of the housing 18. For example, the squeegee assembly 14 may snap or slide into the receiving cavity 42 of the housing 18 in the direction indicated by the arrow A in FIG. 2. Once operatively mounted to the housing 18 (as shown in FIGS. 1 and 8), the squeegee assembly 14 is positioned in front of or within the fluid inlet 29 of the housing 18.

The clamping assembly 22, which is illustrated in an unlocked or released position in FIG. 2, is configured to lock the squeegee assembly 14 to the housing 18 by engaging the bracket 46, as will be described in more detail below. In other examples, the squeegee assembly 14 can include more or less components. As an example, the squeegee assembly 14 may not include the bracket 46, and the squeegee 50 and insert 54 may be inserted directly into the receiving cavity 42 of the housing 18.

Figure 3:
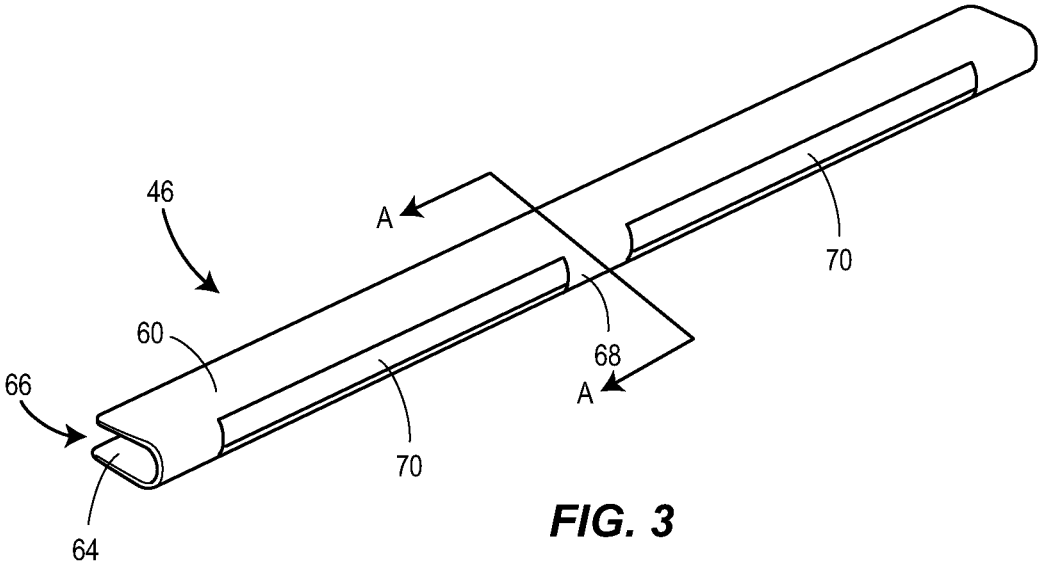
FIG. 3 is a perspective view of a bracket of the squeegee assembly of FIG. 2.
Figure 3A:
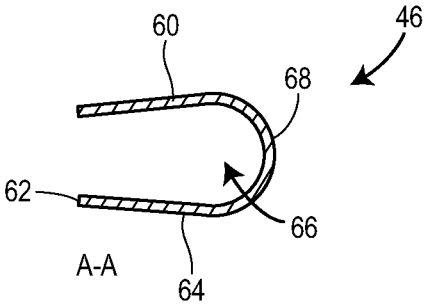
FIG. 3A is a cross-sectional view A-A of the bracket of FIG. 3.

Turning to FIGS. 3-3A, the bracket 46 includes a first plate 60, a second plate 64, and an end wall 68 connecting the first and second plates 60, 64. In this example, the end wall 68 includes a plurality of apertures 70 formed therethrough that permit fluid to flow into the inlet 29 of the housing 18. As illustrated at the cross-section A-A of FIG. 3A, the bracket 46 has a substantially U-shaped cross-section defined by first plate 60, the end wall 68, and the second plate 64. A U-shaped channel 66 of the bracket 46 is sized to receive the squeegee 50. The bracket 46, which may be a metal, plastic, or other suitable material, provides a rigid structure for the squeegee assembly 14 and facilitates insertion and removal of the squeegee assembly 14 to and from the housing 18. In the illustrated example, the bracket 46 may be a single piece of material shaped to form a substantially U-shaped channel. However in other examples, the first and second plates 60, 64 and the end wall 68 may be separate components welded together, bonded, or otherwise attached, to serve as a unitary bracket piece. In other examples, the bracket 46 may include more or fewer apertures 70 in the end wall 68.

Figure 4:
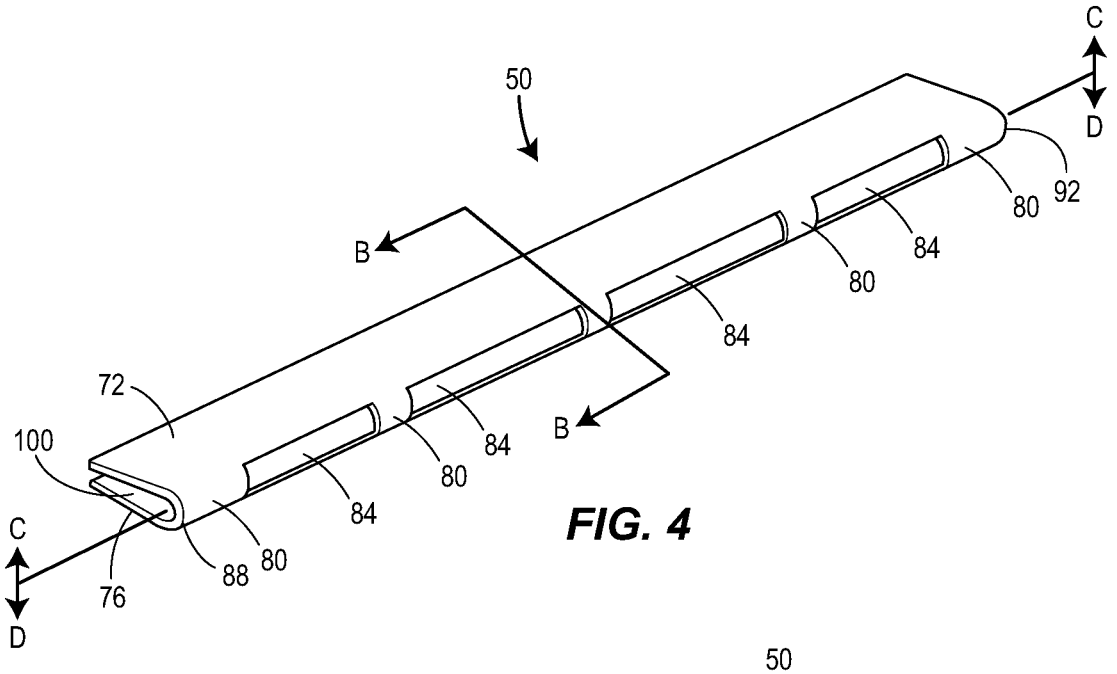
FIG. 4 is a perspective view of a squeegee of the squeegee assembly of FIG. 2.
Figure 4A:
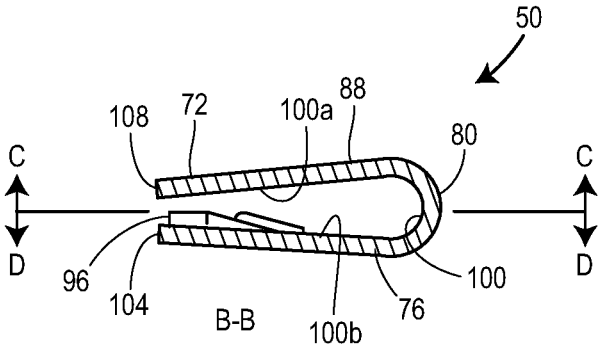
FIG. 4A is a cross-sectional view B-B of the squeegee of FIG. 4.
Figure 4B:
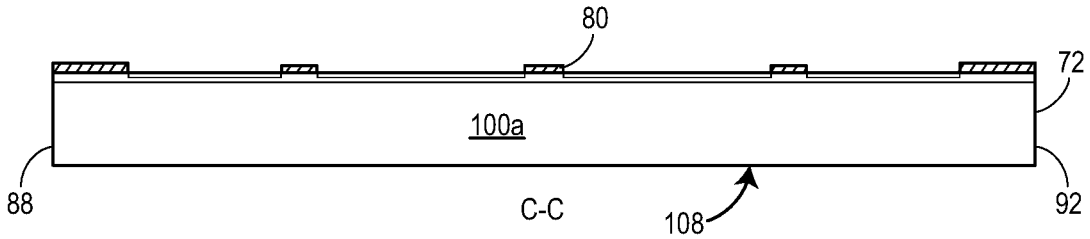
FIG. 4B is a cross-sectional view C-C of the squeegee of FIGS. 4 and 4A.
Figure 4C:
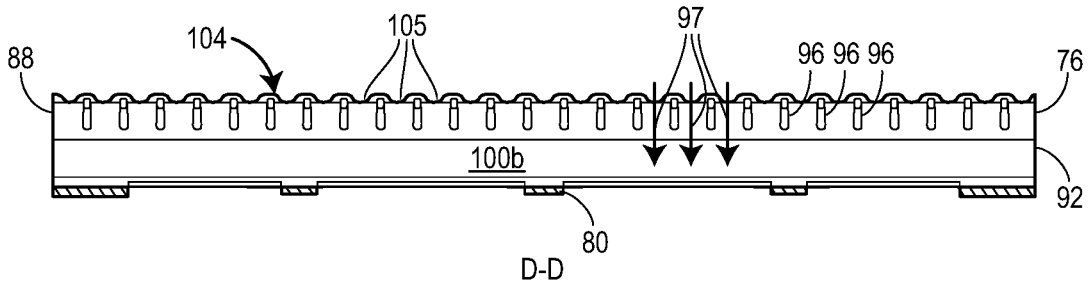
FIG. 4C is a cross-sectional view D-D of the squeegee of FIGS. 4 and 4A.

As illustrated in FIGS. 4-4C, the squeegee 50 includes a first blade 72, a second blade 76, and an elbow 80 connecting the first and second blades 72, 76. In this example, the elbow 80 includes a plurality of apertures 84 therethrough to permit fluid to flow into the inlet 29 of the housing 18. In other examples, the elbow 80 may include more or fewer apertures 84. As shown in the cross-section B-B of FIG. 4A, the squeegee 50 includes a substantially U-shaped cross-section that is defined by the first blade 72, the elbow 80, and the second blade 76. The cross-section extends from a first end 88 of the squeegee 50 to a second end 92 of the squeegee 50 as shown in FIG. 4. In another example, the squeegee 50 may not include the elbow 80, and instead includes two separate blades 72 and 76.

As seen in FIGS. 4A and 4C, the second blade 76 of the squeegee 50 includes a plurality of ridges 96 disposed on an inner surface 100*b* of the squeegee 50. Each ridge 96 includes an inclined upper surface that descends from a front edge 104 of the second blade 76 toward the elbow 80 of the squeegee 50. So configured, the ridges 96 disposed on the second blade 76 may contact an inner surface 100*a* of the first blade 72 of the squeegee 50 without sealing the inlet 29 of the housing 18. The ridges 96 and blades 72 and 76 define passages 97 or airflow paths that permit air to flow through the squeegee 50 when the ridges 96 are touching the inner surface 100*a* of the squeegee 50.

FIGS. 4B and 4C illustrate top views of the inner surface 100*a* of the first blade 72 and the inner surface 100*b* of the second blade 76, respectively. In FIG. 4C, the front edge 104 of the second blade 76 is serrated, forming a series of notches or cutouts 105 along the length of the front edge 104. In another example, the front edge 104 of the second blade 76 may have a smooth edge, for example, like a front edge 108 of the first blade 72 shown in FIG. 4B, or may have an uneven surface. The first blade 72, second blade 76, and elbow 80 are integrally formed, and may be the same material, such as, for example, rubber, neoprene, or gum rubber. In yet another example, the first blade 72 may include a serrated front edge 108 having ridges 96 disposed on an inner surface 100*a*, or may have an uneven surface. The squeegee 50 may be uniform or non-uniform in thickness and/or may be formed using a combination of different materials and parts.

In FIG. 4, the squeegee 50 includes four equally sized apertures 84 that partially overlap with the two apertures 70 of the bracket 46 when the squeegee 50 is positioned between the first and second plates 60, 64 of the bracket 46. The configuration of the apertures 84 of the squeegee 50 and the apertures 70 of the bracket 46 are not limited to the illustrated example in number, size, and/or shape, and may be any suitable configuration that permits fluid to flow into the inlet 29 of the housing 18 and at least partially through one of the apertures 84 of the squeegee 50 and one of the apertures 70 of the bracket 46.

Figure 5:
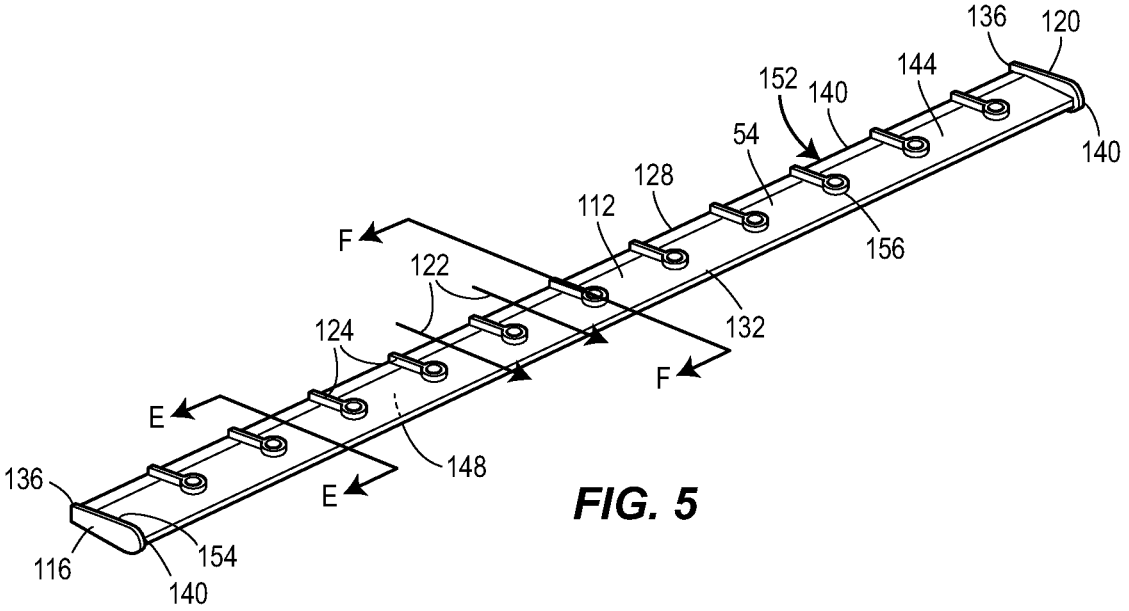
FIG. 5 is a perspective view of an insert of the squeegee assembly of FIG. 2.
Figure 5A:
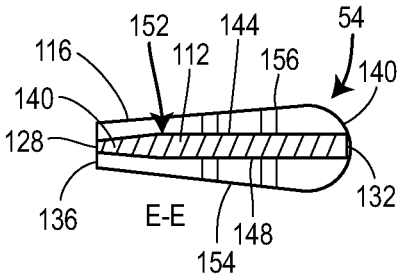
FIG. 5A is a cross-sectional view E-E of the insert of FIG. 5.
Figure 5B:
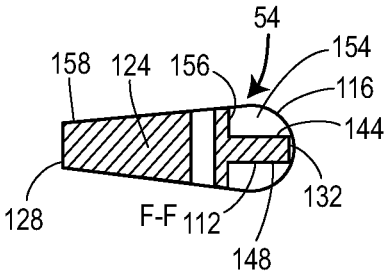
FIG. 5B is a cross-sectional view F-F of the insert of FIG. 5.

Turning now to FIGS. 5-5B, the insert 54, which is configured to be removably disposed between the first blade 72 and the second blade 76 of the squeegee 50, includes an elongated body 112, extending from a first capped end 116 to a second capped end 120, and a plurality of protrusions 124 disposed on the elongated body 112. The insert 54 may be a hard or soft plastic such as, for example, polypropylene or may be formed of other suitable materials.

As shown in FIG. 5, the elongated body 112 of the insert 54 includes a front edge 128, a back edge 132, and opposing first and second capped ends 116, 120. Each capped end 116, 120 forms a flange relative to the body 112 that extends outwardly and away from the elongated body 112. Each capped end 116, 120 includes a narrow leading edge 136 that is aligned in parallel with the front edge 128 of the body 112, and a curved trailing edge 140 that is aligned with the back edge 132 of the elongated body 112. As shown in FIG. 5A, an outer perimeter 154 of the insert 54 is defined by the shape of the flange of the first capped end 116, which in this example has a rounded teardrop shape. The first and second capped ends 116, 120 may be sized and shaped, for example, with smooth curved edges to sealingly engage the first and second ends 88, 92 of the squeegee 50, respectively. The capped ends 116, 120 are shaped to seal against an inner surface 100 of the elbow 80 and the inner surfaces 100*a*, and 100*b* of the blades 72 and 76 of the squeegee 50 and to prevent air from flowing through the first and second ends 88, 92 of the squeegee 50. The capped ends 116, 120 effectively seal the squeegee 50 so that the suction force of the vacuum does not draw air from the sides 88, 92 of the squeegee 50, and therefore concentrates air suction between the capped ends. As such, the capped ends 116, 120 provide barriers to air flow so that a plurality of air flow paths 122 (best shown in FIG. 6A) formed between the elongated body 112 of the insert 54 and the squeegee 50 remain within the defined area.

As best seen in FIG. 5A, the front edge 128 of the elongated body 112 has a tapered tip 140 that is angled on both a top surface 144 and a bottom surface 148 of the elongated body 112. The top and the bottom surfaces 144, 148 of the elongated body 112 run parallel, or substantially parallel, from an end 152 of the tapered tip 140 to the back edge 132 of the elongated body 112. In other examples, the tapered tip 140 may be angled on just one of the top and bottom surfaces 144, 148 of the insert 54.

The protrusions 124 of the elongated body 112 in FIG. 5 are parallel ribs 124 that are evenly spaced and disposed on both the top and bottom surfaces 144, 148 of the elongated body 112. Each of the ribs 124 extends from the front edge 128 of the body 112 to a rib end 156, which is located between the front edge 128 and the back edge 132 of the elongated body 112. As shown in FIG. 5B, an outer perimeter 158 of the rib 124 from the front edge 128 to the rib end 156 is parallel to the outer perimeter 154 of the capped ends 116, 120 of the insert 54. As shown in FIG. 5B, the rib 124 extends vertically from both the top surface 144 and the bottom surface 148 of the elongated body 112. In this example, the outer perimeter 154 of the insert 54 and the outer perimeter 158 of the rib 124 are substantially uniform in height so that the insert 54 seals with the inner surfaces 100, 100*a*, and 100*b* of the squeegee 50 at a plurality of sealing locations when the insert 54 is arranged within the squeegee 50. The ribs 124 form channels that allow fluid to flow over a wide target area rather than a narrow concentrated area of the inlet of tube 36.

In another example, the ribs 124 may extend from the front edge 128 to the back edge 132 of the elongated body 112 instead of ending at the rib end 156. In yet another example, the ribs 124 may extend from only one of the top and bottom surfaces 144, 148 of the elongated body 112, and may be spaced away from the front edge 128. The ribs or protrusions 124 may have a different structure, e.g. elevated knobs, bumps, and/or walls, formed or otherwise attached to the elongated body 112 of the insert 54. The protrusions 124 may be perpendicularly disposed to the front edge 128, as illustrated in FIGS. 5-5B, or the protrusions 124 may be angled relative to the front and back edges 128, 132 of the elongated body 112. The protrusions 124 may be evenly spaced on the elongated body 112, or placed in an arrangement to create a desired air flow effect between the insert 54 and the squeegee 50.

Figure 6:
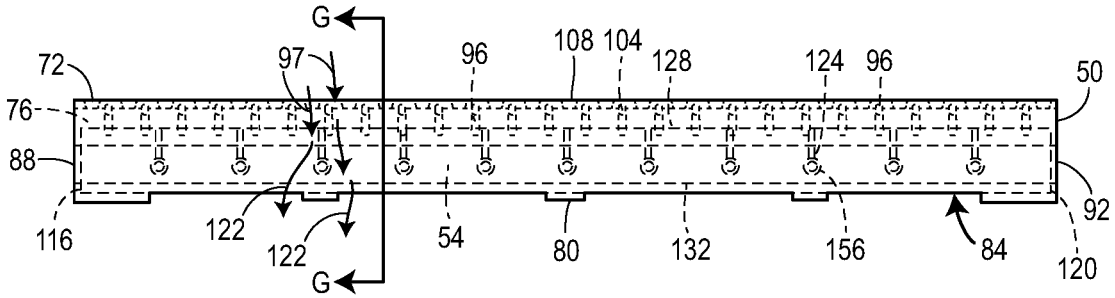
FIG. 6 is a top view of the insert of FIG. 5 disposed within the squeegee of FIG. 4.
Figure 6A:
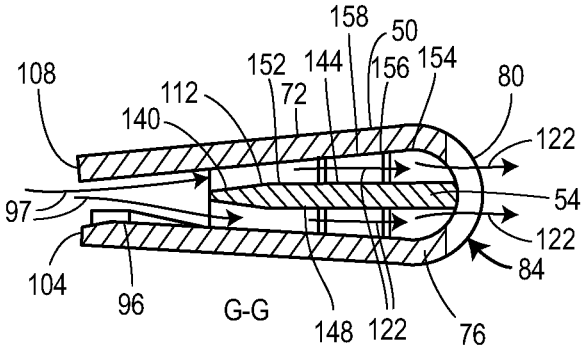
FIG. 6A is a cross-sectional view G-G of the squeegee and insert of FIG. 6.

FIGS. 6 and 6A illustrate airflow paths 97 and 122 of the squeegee assembly 14 that are at least partially defined by the insert 54 of FIGS. 5-5B and the squeegee 50 of FIGS. 4-4A. In the top view of FIG. 6, the insert 54 (in dashed lines) positioned, or disposed, between the top blade 72 and the bottom blade 76 (also shown in dashed lines) of the squeegee 50. The insert 54 generally divides the U-shaped squeegee 50 into a top airflow path between the top surface 144 of the elongated body 112 and the first blade 72, and a bottom airflow path between the bottom surface 148 of the elongated body 112 and the second blade 76. In this way, the ribs 124 of the insert 54 divide the top and bottom airflow paths into a plurality of airflow paths 122 that are further defined by the insert 54, namely the ribs 124, and the squeegee 50.

As shown in FIG. 6A, the outer perimeter 158 of the rib 124 and the outer perimeter 154 of the capped end 116 are engaged with the inner surfaces 100, 100*a*, and 100*b* of the squeegee 50. Both the rib 124 and the capped end 116 define barriers to a plurality of airflow paths 122, for example, between the squeegee 50 and the insert 54 on either side of the rib 124 and the capped end 116. The arrows 97 and 122 in FIGS. 6 and 6A illustrate how air may flow between the front edges 108, 104 of the first and second blades 72, 76 of the squeegee 50, above and below the tapered tip 140 of the elongated body 112, and through a plurality of gaps, e.g., airflow paths, formed between the ribs 124 of the insert 54 and the inner surfaces 100, 100*a*, and 100*b* of the squeegee 50.

Turning now to FIGS. 7-7C, the insert 54, squeegee 50, and bracket 46 of the squeegee assembly 14 are shown assembled and configured to be inserted within the receiving cavity 42 of the housing 18. When fully assembled, the elbow 80 of the squeegee 50 is adjacent to the end wall 68 of the bracket 46, and the back edge 132 of the insert 54 is disposed adjacent to or against the elbow 80 of the squeegee 50. The first and second capped ends 116, 120 are sealably engaged with the first and second ends 88, 92 of the squeegee 50 in a manner illustrated in the side view of the assembly 14 in FIG. 7A. The apertures 84 of the squeegee 50 partially overlap with the apertures 70 of the bracket 46, permitting fluid to flow between the front edges 108, 104 of the first and second squeegee blades 72, 76, through at least one of the apertures 84 of the squeegee 50 and at least one of the apertures 70 of the bracket 46, and finally into the inlet 29 of the housing 18. The capped ends 116, 120 seal off the squeegee assembly 14 and define a contained airflow area between the first and second ends 88, 92 of the squeegee 50.

Referring again to FIG. 2, a length $L_B$ of the bracket 46 measured from end to end may be approximately equal to a length $L_S$ of the squeegee 50. A length $L_I$ of the insert 54 may be approximately equal to the length $L_S$ of the squeegee 50. In a preferred embodiment, the length $L_S$ of the squeegee 50 is greater than the length $L_B$ of the bracket 46. In other examples, the lengths $L_B$, $L_S$, $L_I$ of the bracket 46, squeegee 50, and insert 54 may vary and are not limited to the configuration illustrated in the figures herein. In a preferred embodiment, a width $W_S$ of the squeegee 50, as measured from the elbow 80 to the front edge 108, 104 of either first or second blade 72, 76, is greater than a width $W_B$ of the bracket 46, which is similarly measured from the end wall 68 to a front edge 62 of the bracket 46. A width $W_I$ of the insert 54, which is measured from the leading edge 136 to the trailing edge 140 of the capped ends 116, 120, is less than the width $W_S$ of the squeegee 50.

The squeegee accessory 10 may be attached to a hose of a wet/dry vacuum cleaner to distribute air suction across a length $L_H$ of the housing 18. The insert 54 may keep the squeegee 50 from collapsing and obstructing the inlet 29 of the housing 18 and may provide a substantially uniform air flow across the length $L_S$ of the squeegee 50. The insert 54 may limit the front edges 108, 104 of the squeegee 50 from being drawn together by the vacuum pressure. Additionally, the tapered tip 140 and protrusions 124 of the body 112 may help distribute or funnel air flow over the length $L_S$ of the squeegee 50 so the squeegee accessory 10 can clean, i.e. squeegeeing and collecting debris, across a wide target surface area spanning from opposing ends 88, 92 of the squeegee 50.

FIG. 8 illustrates a cross-sectional view of the squeegee accessory 10 of FIG. 1 where the squeegee assembly 14 is operatively mounted within the receiving cavity 42 of the housing 18 and the clamping assembly 22 is in the unlocked position. The clamping assembly 22 includes a biasing plate 160 and a spring-biased knob 164. The biasing plate 160 is disposed within the inlet 29 of the housing 18 and is coupled to the spring-biased knob 164 at a back portion 168 of the biasing plate 160. A front portion 172 of the plate 160 is curved to receive the squeegee assembly 14 when the squeegee assembly 14 is inserted into the receiving cavity 42 of the housing 18 and the clamping assembly 22 is in the unlocked position.

The spring-biased knob 164 includes a lever 176, a bolt 180, and a biasing element, such as a spring 184. The bolt 180 traverses the top cover 34 of the housing 18 to couple the lever 176 to the biasing plate 160. The bolt 180 is secured to the top cover 34 by a top fastener 188 and is attached to the back portion 168 of the biasing plate 160 by a bottom fastener 192. The spring 184 is placed around the bolt 180 and disposed between the top cover 34 of the housing 18 and the back portion 168 of the biasing plate 160. The lever 176, which is disposed on the exterior surface 52 of the housing 18, is coupled to the top fastener 188. The lever 176 has a cam surface 190 configured such that when the lever 176 rotates clockwise in a direction J to occupy the locked configuration, the lever 176 pulls the top fastener 188 and the bolt 180 in the vertical direction, thereby lifting the biasing plate 160 and compressing the spring 184 between the top cover 34 and the biasing plate 160. The spring 184 remains in the compressed configuration while the clamping assembly 22 is in the locked configuration, forcing the front portion 172 of the biasing plate 160 to press against the second plate (or bottom plate) 64 of the bracket 46 to secure the squeegee assembly 14 to the housing 18. In other examples, the clamping assembly 22 may include more or fewer components. For example, the spring-biased knob 164 includes two bolts 180 and two biasing elements 184 located on either side of the lever 176. Rotating the lever 176 back in the counter-clockwise direction correspondingly unclamps/unlocks the clamping assembly 22.

The squeegee accessory 10 described and illustrated herein may be designed for a variety of differently sized vacuums. In a second exemplary squeegee accessory 210 of FIG. 9, a squeegee accessory 210 includes the same elements as the squeegee accessory 10 described above, such as, for example, a housing 218, a bracket 246, a squeegee 250, and an insert 254. In the second example squeegee accessory 210, an overall length $L_{H2}$ of a front end 226 of the housing 218 is shorter than the $L_H$ of the front end 26 of the first exemplary squeegee accessory 10 of FIG. 1. The overall length $L_{H2}$ may be based on the air suction capabilities of the attached vacuum (not illustrated) and/or of the cleaning needs of the operator, e.g. target surface area.

While various embodiments have been described above, this disclosure is not intended to be limited thereto. Variations can be made to the disclosed embodiments that are still within the scope of the appended claims.

What is claimed is:

1. A squeegee accessory for a wet/dry vacuum, the accessory comprising:

a housing having a front end including a fluid inlet, a back end including a fluid outlet, and a fluid flow path connecting the fluid inlet and the fluid outlet, a squeegee assembly removably attached to the housing and disposed within the fluid flow path, the squeegee assembly comprising:

a bracket including a first plate, a second plate, and an end wall connecting the first and second plates, the end wall including at least one aperture to permit fluid flow between the fluid inlet and the fluid outlet;

a squeegee removably disposed between the first and second plates of the bracket, the squeegee including a first blade, a second blade, an elbow connecting the first and second blades, and an aperture formed in the elbow to permit fluid flow between the fluid inlet and the fluid outlet, the elbow located adjacent to the end wall of the bracket; and an insert removably disposed between the first and second blades of the squeegee, the insert including a body and a rib disposed on the body, the rib touching an inner surface of the squeegee, wherein the rib and inner surface of the squeegee defining a barrier of an airflow path formed between the insert and the squeegee; and wherein the front end of the housing includes a receiving cavity that receives the squeegee assembly.

2. The squeegee accessory of claim 1, wherein the squeegee includes a U-shaped cross-section defined by the elbow, the first blade, and the second blade, the U-shaped cross-section extending between a first end and a second end of the squeegee.

3. The squeegee accessory of claim 2, wherein the body of the insert includes a first capped end and a second capped end, the first capped end sealingly engaged with the first end of the squeegee and the second capped end sealingly engaged with the second end of the squeegee.

4. The squeegee accessory of claim 1, wherein the first plate, the second plate, and the end wall of the bracket define a U-shaped cross-section, the U-shaped cross-section extending across a length of the front end of the housing.

5. The squeegee accessory of claim 1, wherein the body of the insert includes a plurality of ribs engaged with an inner surface of the first blade of the squeegee, the plurality of ribs defining air flow paths between the insert and the first squeegee blade.

6. The squeegee accessory of claim 5, wherein the body of the insert includes another plurality of ribs engaged with an inner surface of the second blade of the squeegee, the plurality of ribs defining a plurality of air flow paths within the fluid flow path of the housing.

7. The squeegee accessory of claim 1, further comprising an inclined ridge disposed on the inner surface of the squeegee, the inclined ridge configured to keep the first blade and the second blade of the squeegee spaced apart to permit fluid to flow into the fluid inlet of the housing.

8. The squeegee accessory of claim 1, wherein the body of the insert includes a front edge and a back edge, the back edge disposed adjacent to the elbow of the squeegee.

9. The squeegee accessory of claim 1, wherein a length of the bracket is approximately equal to a length of the body of the insert and a length of the squeegee.

10. The squeegee accessory of claim 1, further comprising a receiving clip disposed on an exterior surface of the housing and configured to receive a removable post for a cleaning attachment.

11. The squeegee accessory of claim 1, further comprising a clamping assembly having a biasing plate disposed within the fluid inlet of the housing and a spring-biased knob, the clamping assembly configured to lock the squeegee assembly to the housing by biasing the biasing plate against the bracket of the squeegee assembly, and wherein the clamping assembly is configured to unlock the squeegee assembly from the housing.

12. The squeegee accessory of claim 1, wherein the back end of the housing includes a tube defining the fluid outlet of the housing, the tube being configured to attach to a hose of a wet/dry vacuum.

13. An attachment for a vacuum, the attachment comprising:

a squeegee assembly comprising:

a squeegee including a first blade, a second blade; and an insert disposed between the first blade and the second blade of the squeegee, the insert having a body that at least partially defines a plurality of air flow paths between the insert and the squeegee;

a housing including a front end and a back end fluidly connected by a fluid flow path, the squeegee assembly removably attached to the housing at the front end; and a rib disposed on the elongated body of the insert and in direct contact with the squeegee, the rib providing a barrier for at least one of the plurality of airflow paths.

14. The attachment of claim 13, further comprising a bracket sized to receive the squeegee, the bracket including a first plate, a second plate, and an end wall connecting the first and second plates, the end wall disposed within the fluid flow path and including an aperture that permits fluid to flow through the fluid flow path.

15. The attachment of claim 14, wherein the bracket has a U-shaped cross-section extending from a first end of the bracket to a second end of the bracket.

16. The squeegee of claim 13, wherein the squeegee further comprises an elbow connecting the first and second blades and integrally formed with the first blade and second blade, the elbow including an aperture.

17. The attachment of claim 16, wherein the squeegee includes a first end and a second end, each of the first end and the second end having a substantially U-shaped cross-section defined by the first blade, the second blade, and the elbow.

18. The attachment of claim 13, wherein the squeegee has a length defined between a first end and a second end of the squeegee, the length of the squeegee being approximately equal to a length of the body of the insert.

19. The attachment of claim 13, wherein the body of the insert is disposed between a first capped end and a second capped end, the first capped end and the second capped end sealably engaged with the squeegee.

20. The attachment of claim 13, wherein the body of the insert is partially inclined along a front edge of the body.

21. The attachment of claim 13, wherein the insert includes a plurality of ribs disposed on the body and engaged with an inner surface of the first blade of the squeegee, the plurality of ribs at least partially defining the plurality of air flow paths within the fluid flow path of the housing.

22. The attachment of claim 21, wherein the insert includes another plurality of ribs engaged with an inner surface of the second blade of the squeegee, the plurality of ribs at least partially defining a plurality of air flow paths within the fluid flow path of the housing.

23. The attachment of claim 13, further comprising a clamping assembly having a biasing plate disposed within a fluid inlet of the housing and a spring-biased knob disposed on an exterior surface of the housing, the clamping assembly configured to lock the squeegee assembly to the housing by biasing the biasing plate against the bracket of the squeegee assembly, the clamping assembly configured to unlock the squeegee assembly from the housing.

24. The attachment of claim 13, further comprising a locking assembly coupled to the housing and configured to lock the squeegee assembly to the front end of the housing and to unlock the squeegee assembly from the front end of the housing.

25. The attachment of claim 13, wherein the housing includes a receiving cavity formed in the front end and sized to receive the squeegee assembly, a top cover, and a bottom cover secured to the top cover, the top cover and the bottom cover forming the receiving cavity.

26. The attachment of claim 13, wherein the back end of the housing includes a tube configured to couple to a vacuum hose.

27. An attachment for use with a vacuum cleaner, the attachment comprising:

a housing having a front end including an inlet, a back end including an outlet, and a fluid flow path connecting the inlet and the outlet;

a tube defining the outlet and disposed at the back end of the housing and configured to attach to a hose of a vacuum;

a squeegee assembly disposed within an opening of the housing at the front end and disposed within the fluid flow path, the squeegee assembly comprising:

a bracket having a first plate, a second plate, and an end wall connecting the first plate and second plate, the bracket including a substantially U-shaped cross-section extending a length of the front end of the housing, the end wall including an aperture;

a squeegee disposed between the first plate and the second plate of the bracket, the squeegee including a first blade, a second blade, and an elbow connecting the first and second blades, the elbow having an aperture, an insert disposed between the first blade and the second blade of the squeegee, the insert having a body with a parallel front edge and parallel back edge, the front edge being inclined and the back edge positioned adjacent to the elbow of the squeegee, the insert including a rib perpendicularly situated relative to the front edge and back edge and disposed on the inclined edge, the rib sealingly engaging an inner surface of the squeegee; and a clamping assembly having a biasing plate disposed within the inlet of the housing and a spring-biased knob configured to lock the squeegee assembly to the housing and unlock the squeegee assembly from the housing.

* * * * *